US011263945B2

(12) United States Patent
Li

(10) Patent No.: US 11,263,945 B2
(45) Date of Patent: Mar. 1, 2022

(54) DRIVING METHOD OF DISPLAY PANEL, DRIVING CIRCUIT AND DISPLAY DEVICE

(71) Applicant: HKC CORPORATION LIMITED, Shenzhen (CN)

(72) Inventor: Zeyao Li, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/040,982

(22) PCT Filed: Jan. 29, 2019

(86) PCT No.: PCT/CN2019/073630
§ 371 (c)(1),
(2) Date: Sep. 24, 2020

(87) PCT Pub. No.: WO2020/143088
PCT Pub. Date: Jul. 16, 2020

(65) Prior Publication Data

US 2021/0097917 A1 Apr. 1, 2021

(30) Foreign Application Priority Data

Jan. 9, 2019 (CN) ..... 201910018438.5

(51) Int. Cl.
*G09G 3/20* (2006.01)

(52) U.S. Cl.
CPC ..... *G09G 3/20* (2013.01); *G09G 2310/0267* (2013.01); *G09G 2310/08* (2013.01); *G09G 2320/043* (2013.01); *G09G 2330/02* (2013.01)

(58) Field of Classification Search
None
See application file for complete search history.

(56) References Cited

U.S. PATENT DOCUMENTS

2006/0061535 A1* 3/2006 Kim ..... G11C 19/28 345/98
2008/0012842 A1* 1/2008 Mori ..... G09G 3/3677 345/206
2016/0293079 A1 10/2016 Kim et al.

FOREIGN PATENT DOCUMENTS

| | | | |
|---|---|---|---|
| CN | 1652193 | A | 8/2005 |
| CN | 101105918 | A | 1/2008 |
| CN | 101799604 | A | 8/2010 |
| CN | 105528987 | A | 4/2016 |
| CN | 105976787 | A | 9/2016 |

OTHER PUBLICATIONS

Xi Yang, the ISA written comments,dated Oct. 2019, CN.
Xi Yang, the International Search Report, dated Oct. 2019, CN.

* cited by examiner

*Primary Examiner* — Ifedayo B Iluyomade

(57) ABSTRACT

This application discloses a driving method of a display panel, a driving circuit and a display device. The display panel includes a first gate driving circuit and a second gate driving circuit respectively controlling all gate lines in a scanning display area, and the driving method includes the following steps: when a first preset condition is met, controlling the first gate driving circuit to be in a dormant state, and meanwhile, controlling the second gate driving circuit to be in a working state; and when a second preset condition is met, controlling the second gate driving circuit to be in a dormant state, and meanwhile, controlling the first gate driving circuit to be in a working state.

11 Claims, 6 Drawing Sheets

DRIVING METHOD OF DISPLAY PANEL, DRIVING CIRCUIT AND DISPLAY DEVICE

This application claims the priority to the Chinese Patent Application No. CN201910018438.5, filed with National Intellectual Property Administration, PRC on Jan. 9, 2019 and entitled "DRIVING METHOD OF DISPLAY PANEL, DRIVING CIRCUIT AND DISPLAY DEVICE", which is incorporated herein by reference in its entirety.

TECHNICAL FIELD

This application relates to the field of display technologies, and in particular, to a driving method of a display panel, the display panel and a display device.

BACKGROUND

Statement herein merely provides background information related to this application and does not necessarily constitute the prior art.

With development and advancement of science and technologies, due to hot spots such as thinness, power saving, and low radiation, flat-panel displays become mainstream products of displays and are widely applied. A flat-panel display includes a Thin Film Transistor-Liquid Crystal Display (TFT-LCD) and an Organic Light-Emitting Diode (OLED) display, etc. The TFT-LCD controls rotating directions of liquid crystal molecules, to enable light in a backlight module to be refracted out to generate a picture, and the TFT-LCD has various advantages such as thin body, power saving, and no radiation. The OLED display is manufactured by using an organic electroluminescent diode, and has various advantages such as self-luminescent, short response time, high resolution and contrast, flexible display, and large area full color display.

A Gate Driver On Array (GOA) technology causes influence to the normal operation of the GOA circuit because a Threshold Voltage (Vth) in the electric properties of an amorphous silicon thin film transistor generates big change along with the long-terminal lasting work of the transistor in application of an amorphous silicon semiconductor device, and therefore, there is an urgent need for a design to solve the problem.

SUMMARY

This application provides a driving method of a display panel, a driving circuit and a display device, which can increase the reliability and long-term stability of a gate driving circuit.

In order to achieve the foregoing aim, the present invention provides a driving method of a display panel, wherein the display panel includes a first gate driving circuit and a second gate driving circuit, the first gate driving circuit receives first input signals, and controls to output a gate start signal to be used for scanning all gate lines in a display area of the display panel; the second gate driving circuit receives second input signals associated with the first input signals, and controls to output a gate start signal to be used for scanning all gate lines in the display area of the display panel; and the method includes:

when a first preset condition is met, controlling the first gate driving circuit to be in a dormant state, and meanwhile, controlling the second gate driving circuit to be in a working state; and when a second preset condition is met, controlling the second gate driving circuit to be in a dormant state, and meanwhile, controlling the first gate driving circuit to be in a working state.

Optionally, timing is carried out from the moment of start of the first gate driving circuit, and when the timing time reaches a first preset time interval, the first preset condition is met; and timing is carried out from the moment of start of the second gate driving circuit, and when the timing time reaches a second preset time interval, the second preset condition is met.

Optionally, a scanning frame number from the start of the first gate driving circuit is counted, and when the scanning frame number reaches a preset switching value, the first preset condition is met; and a scanning frame number from the start of the second gate driving circuit is counted, and when the scanning fame number reaches a preset switching value, the second preset condition is met.

Optionally, the driving method includes: when the first preset condition is met, controlling to interrupt the output of a frame start signal to the first gate driving circuit, and controlling the first gate driving circuit to be in, a dormant state; and meanwhile, opening the output of a frame start signal to the second gate driving circuit, and controlling the second gate driving circuit to be in a working state; and when the second preset condition is met, controlling to open the output of the frame start signal to the first gate driving circuit, and controlling the first gate driving circuit to be in a working state; and meanwhile, interrupting the output of the frame start signal to the second gate driving circuit, and controlling the second gate driving circuit to be in a dormant state.

Optionally, the driving method includes: when the first preset condition is met, outputting a first switching signal to the first gate driving circuit, and controlling the first gate driving circuit to be in a dormant state; and meanwhile, outputting a second switching signal to the second gate driving circuit, and controlling the second gate driving circuit to be in a working state;

when the second preset condition is met, outputting the second switching signal to the second gate driving circuit, and controlling the second gate driving circuit to be in a dormant state; and meanwhile, outputting a first switching signal to the first gate driving circuit, and controlling the first gate driving circuit to be in a working state.

Optionally, the driving method includes: when the first preset condition is met, turning off a power source of the first gate driving circuit, and meanwhile, turning on a power source of the second gate driving circuit; and when the second preset condition is met, turning on the power source of the first gate driving circuit, and meanwhile, turning off the power source of the second gate driving circuit.

Optionally, the driving method includes: when the first preset condition is met, outputting a high level signal to the first gate driving circuit and the second gate driving circuit at the same time, turning off the power source of the first gate driving circuit, and meanwhile, turning on the power source of the second gate driving circuit; and when the second preset condition is met, outputting a low level signal to the first gate driving circuit and the second gate driving circuit at the same time, turning on the power source of the first gate driving circuit, and meanwhile, turning off the power source of the second gate driving circuit.

The present invention further discloses a driving circuit of a display panel, wherein the driving circuit includes a time sequence controller and a switcher, the time sequence controller outputs first input signals to the first gate driving circuit of the display panel, and outputs second input signals to the second gate driving circuit of the display panel; and the switcher is in controlled connection with the first gate driving circuit of the display panel and the second gate driving circuit of the display panel, and controls only one of the first gate driving circuit and the second gate driving circuit to be in working at the same time according to the first preset condition or the second preset condition.

Optionally, the switcher includes a counter and a control circuit, the counter is used for counting a scanning frame number of the first gate driving circuit or the second gate driving circuit output by the time sequence controller; the control circuit is in controlled connection with the counter, and controls to connect the first gate driving circuit or the second gate driving circuit of the display panel; when the scanning frame number counted by the counter reaches a preset switching value, it is regarded as reaching a preset time interval, that is, when the first preset condition or the second preset condition is met, the counter informs the control circuit, and the control circuit outputs a corresponding frame start signal to the first gate driving circuit and the second gate driving circuit.

The present invention further discloses a display device, including the display panel and the foregoing driving circuit of the display panel, wherein the display panel is divided into a display area and a non-display area, the display panel includes: a first gate driving circuit and a second gate driving circuit, the first gate driving circuit is arranged in the non-display area, and controls to output a gate start signal to be used for scanning all gate lines in the display area; and the second gate driving circuit is arranged in the non-display area, and controls to output a gate start signal to be used for scanning all gate lines in the display area; the driving circuit includes a time sequence controller and a switcher, wherein time sequence controller outputs first input signals to the first gate driving circuit and outputs second input signals to the second gate driving circuit; and the switcher is in controlled connection with the first gate driving circuit and the second gate driving circuit, and controls only one of the first gate driving circuit and the second gate driving circuit to be in working at the same time according to the first preset condition or the second preset condition.

For a scheme that one gate driving circuit correspondingly drives one display panel, two sets of gate driving circuits are designed, which respectively drive a same display panel, the first gate driving circuit and the second gate driving circuit respectively receive first input signals and second input signals, and therefore, the first gate driving circuit and the second gate driving circuit can realize independent control without mutual influence; moreover, the first gate driving circuit and the second gate driving circuit are both connected with all gate lines in the same display panel, and can control to scan all the gate lines, and therefore, at the same moment, only one of the two sets of gate driving circuits is controlled to be in a working state, and the other set is in a dormant state, and the problems about working reliability and long-term stability of the gate driving circuits are solved; and in the same time, the two sets of gate driving circuits drive the same display panel in turn, and in comparison with a manner that only one gate driving circuit drives the display panel at the same time, the average working time of each set of gate driving circuit is reduced by a half, and the reliability and long-term stability are improved twice.

BRIEF DESCRIPTION OF DRAWINGS

The drawings included are used for providing understanding of embodiments of the present application, constitute part of the specification, and are used for illustrating implementation manners of the present application, and interpreting principles of the present application together with text description. Apparently, the accompanying drawings in the following descriptions are merely some embodiments of this application, and a person of ordinary skill in the art can also obtain other accompanying drawings according to these accompanying drawings without involving any creative effort. In the accompanying drawings.

DETAILED DESCRIPTION OF EMBODIMENTS

Figure 1:
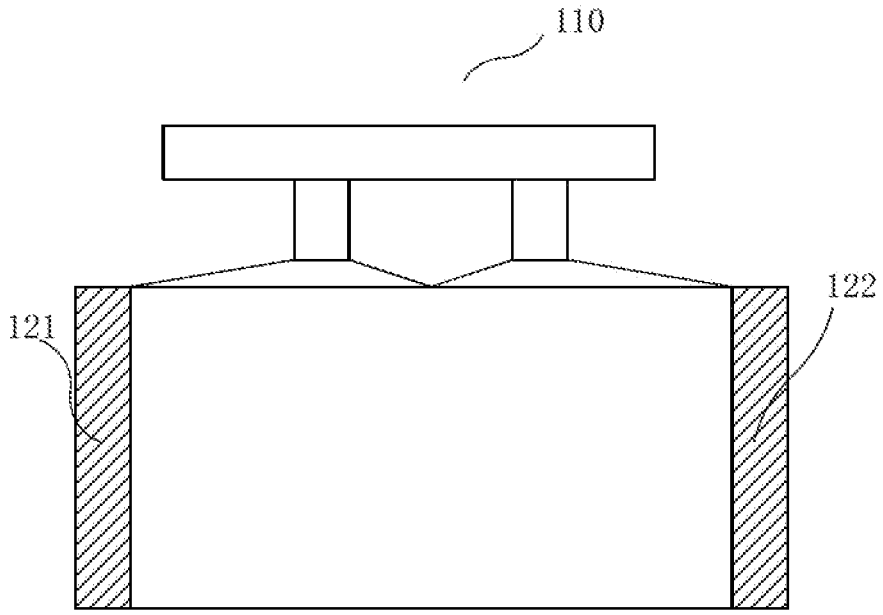
FIG. 1 is a schematic diagram of a display panel of an embodiment of the present invention.

Specific structures and functional details disclosed herein are merely representative, and are intended to describe the objectives of exemplary embodiments of this application. However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right". "vertical". "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms such as "first" and "second" are used only for the purpose of description, and should not be understood as indicating or implying the relative importance or implicitly specifying the number of the indicated technical features. Therefore, a feature defined by "first" or "second" can explicitly or implicitly includes one or more of said features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, and/or operations, but do not preclude the presence or addition of one or more other features, integers, steps, operations, and/or combinations thereof.

Illustration will be made to this application by referring to drawings and optional embodiments.

FIG. 1 shows a display panel. The display panel 110 includes a first gate driving circuit 121 and a second gate driving circuit 122. The first gate driving circuit 121 receives first input signals, and controls to output a gate start signal to be used for scanning all gate lines in the display area of the display panel. The second gate driving circuit 122 receives second input signals associated with the first input signals, and controls to output a gate start signal to be used for scanning all gate lines in the display area of the display panel.

Figure 2:
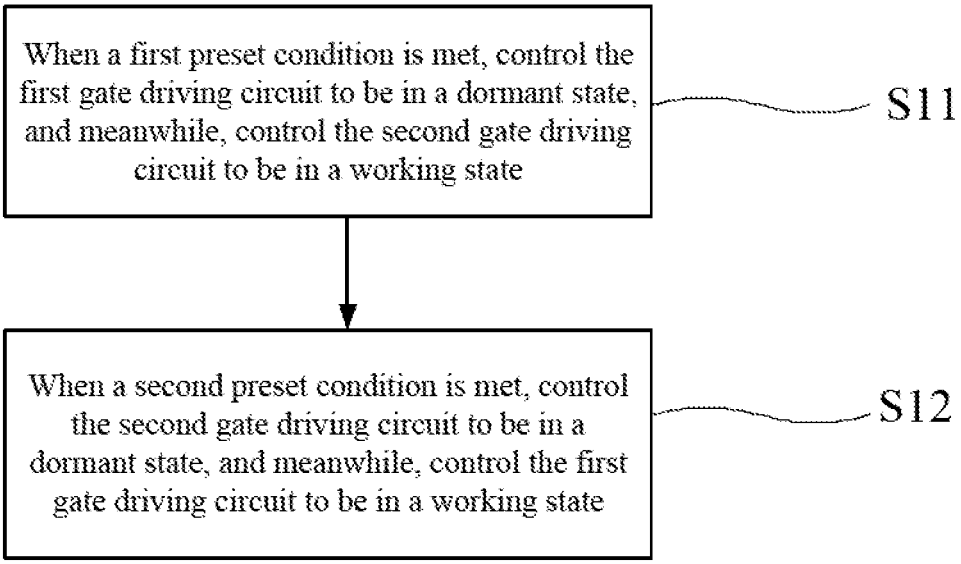
FIG. 2 is a schematic diagram of steps of a driving method of the display panel of an embodiment of the present invention.

FIG. 2 is a flow diagram of the driving method of the display panel. It is known by referring to FIG. 2 and in combination with FIG. 1 that the driving method of the display panel includes the following steps:

S11: when a first preset condition is met, controlling the first gate driving circuit to be in a dormant state, and meanwhile, controlling the second gate driving circuit to be in a working state; and S12: when a second preset condition is met, controlling the second gate driving circuit to be in a dormant state, and meanwhile, controlling the first gate driving circuit to be in a working state.

The first gate driving circuit 121 and the second gate driving circuit 122 of the display panel are respectively used for receiving the first input signals and the second input signals. The first gate driving circuit 121 and the second gate driving circuit 122 are both connected with all the gate lines and are capable of controlling to scan all the gate lines. At the same moment, for the first gate driving circuit 121 and the second gate driving circuit 122, the first gate driving circuit 121 is controlled to be in a working state, while the second gate driving circuit 122 is controlled to be in a dormant state, or the first gate driving circuit 121 is controlled to be in a dormant state, while the second gate driving circuit 122 is controlled to be in a working state. In this way, the first gate driving circuit and the second gate driving circuit do not influence each other, and the problems about working reliability and long-term stability of the gate driving circuit are solved; in the same time, the two gate driving circuits drive the same display panel separately, and in comparison with a manner that only one gate driving circuit drives the display panel in the same time, the average working time of each set of gate driving circuit is reduced by a half, and the reliability and long-term stability are improved twice.

Figure 3:
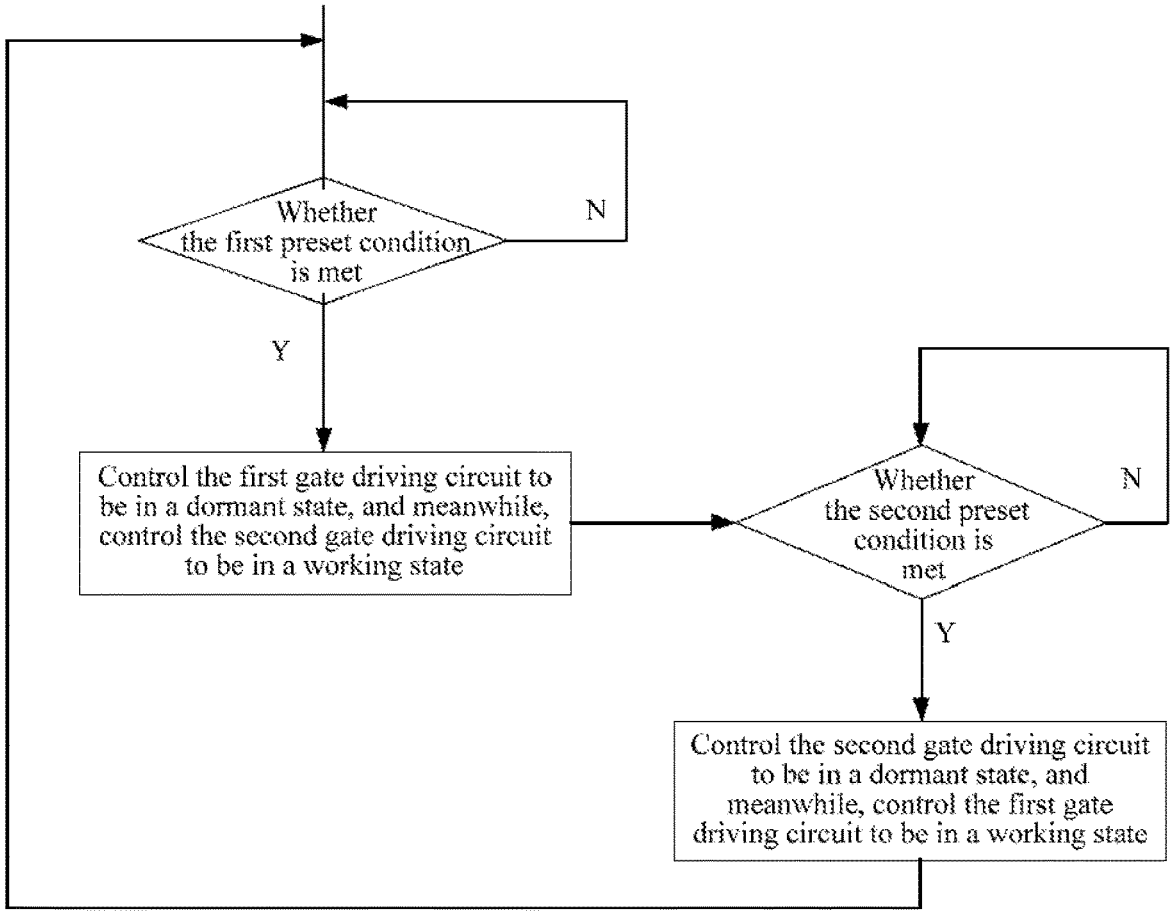
FIG. 3 is a schematic diagram of a flow of the driving method of the display panel of an embodiment of the present invention.

Moreover, what needs to be illustrated is that, as shown in FIG. 3, when it is determined that the first preset condition is met, and when the step of controlling the first gate driving circuit to be in a dormant state, while controlling the second gate driving circuit to be in a working state is executed, whether the second preset condition is met is started to be determined. Similarly, when it is determined that the second preset condition is met, when the step of controlling the second gate driving circuit to be in a dormant state, while controlling the first gate driving circuit to be in a working state is executed, whether the first preset condition is met is started to be determined. This is a mutual triggering process.

In one or more embodiments, timing may be taken as a criterion for judging whether the first preset condition or the second preset condition is met. Timing is carried out from the moment of start of the first gate driving circuit, and when the timing time reaches a first preset time interval, the first preset condition is met; and timing is carried out from the moment of start of the second gate driving circuit, and when the timing time reaches a second preset time interval, the second preset condition is met. Because the threshold voltage (Vth) in electrical properties of thin film transistor generates big change along with the long-term lasting work of the transistor, the normal work of the gate driving circuit is affected, and therefore, in the scheme, a time interval is preset, so that whether the first preset condition or the second preset condition is met is determined according to the present time interval when the working duration reaches a proper degree, so as to control the first gate driving circuit and the second gate driving circuit to work alternately. The first time interval and the second time interval may be set by a time sequence controller of the display panel, certainly, may be also set by other suitable elements.

In one or more embodiments, counting may be taken as a criterion for judging whether the first preset condition or the second preset condition is met. A scanning frame number from the start of the first gate driving circuit is counted, and when the scanning frame number reaches a preset switching value, the first preset condition is met; a scanning frame number from the start of the second gate driving circuit is counted, and when the scanning frame number reaches a preset switching value, the second preset condition is met. Counting of the scanning frame number ensures that switching between the first gate driving circuit and the second gate driving circuit is performed only after each frame is completed, so as to avoid the occurrence of the problem that a frame of picture is not completely displayed, and avoid the occurrence of extra display problems while keeping the stability of the thin film transistors and prolonging the service life of the thin film transistor. The preset switching value of the scanning frame number is set by the time sequence controller, and certainly, may be also set by other suitable elements. The scanning frame number is calculated by a counter, and the counting may be realized by counting the frame start signal.

In one or more embodiments, the frame start signal may be controlled to control the working state or the dormant state of the first gate driving circuit and the second gate driving circuit. When the first preset condition is met, the input of the frame start signal to the first gate driving circuit is controlled to be interrupted, and the first gate driving circuit is controlled to be in a dormant state, and meanwhile, the input of the frame start signal to the second gate driving circuit is opened, and the second gate driving circuit is controlled to be in a working state. When the second preset condition is met, the input of the frame start signal to the first gate driving circuit is controlled to be opened, and the first gate driving circuit is controlled to be in a working state, meanwhile, the input of the frame start signal to the second gate driving circuit interrupted, and the second gate driving circuit is controlled to be in a dormant state. When the first gate driving circuit works, the frame start signal is not input to the second gate driving circuit, and when the second gate driving circuit works, the frame start signal is not input to the first gate driving circuit. Input of the frame start signal ensures that influence is not generated to scanning of the two gate driving circuits to the display panel in each time of switching, and then the situation that mutual interference is caused as the other gate driving circuit already starts to scan when the scanning of one gate driving circuit is not ended yet is avoided.

Figure 4:
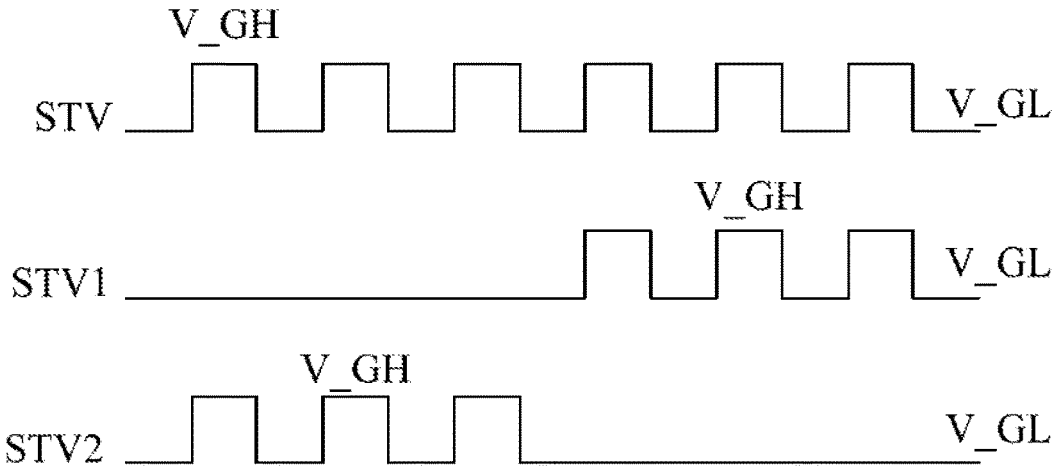
FIG. 4 is a waveform schematic diagram of a frame start signal of the display panel of an embodiment of the present invention.

FIG. 4 shows a specific frame start signal output example. The fame start signal (STV) is output by a time sequence controller. A first frame start signal (STV1) and a second frame start signal (STV2) are generated according to the frame start signal (STV). When the first preset condition is met (with three frame start signals as a counting cycle as an example), STV1 is transmitted to the first gate driving circuit as a first switching signal, a waveform corresponding to the STV1 is a continuous low level, and the first gate driving circuit is controlled to be in a dormant state. Meanwhile, STV2 is transmitted to the second gate driving circuit as a second switching signal, a waveform corresponding to the STV2 is the same square wave as the STV signal, and the second gate driving circuit is controlled to be in a working state. When the second preset condition is met (with three frame start signals as a counting cycle as an example), STV2 is transmitted to the second gate driving circuit as a second switching signal, a waveform corresponding to the STV2 is a continuous low level, and the second gate driving circuit is controlled to be in a dormant state. Meanwhile STV1 is transmitted to the first gate driving circuit as a first switching signal, a waveform corresponding to the STV1 is the same square wave as the STV signal, and the first gate driving circuit is controlled to be in a working state.

Figure 5:
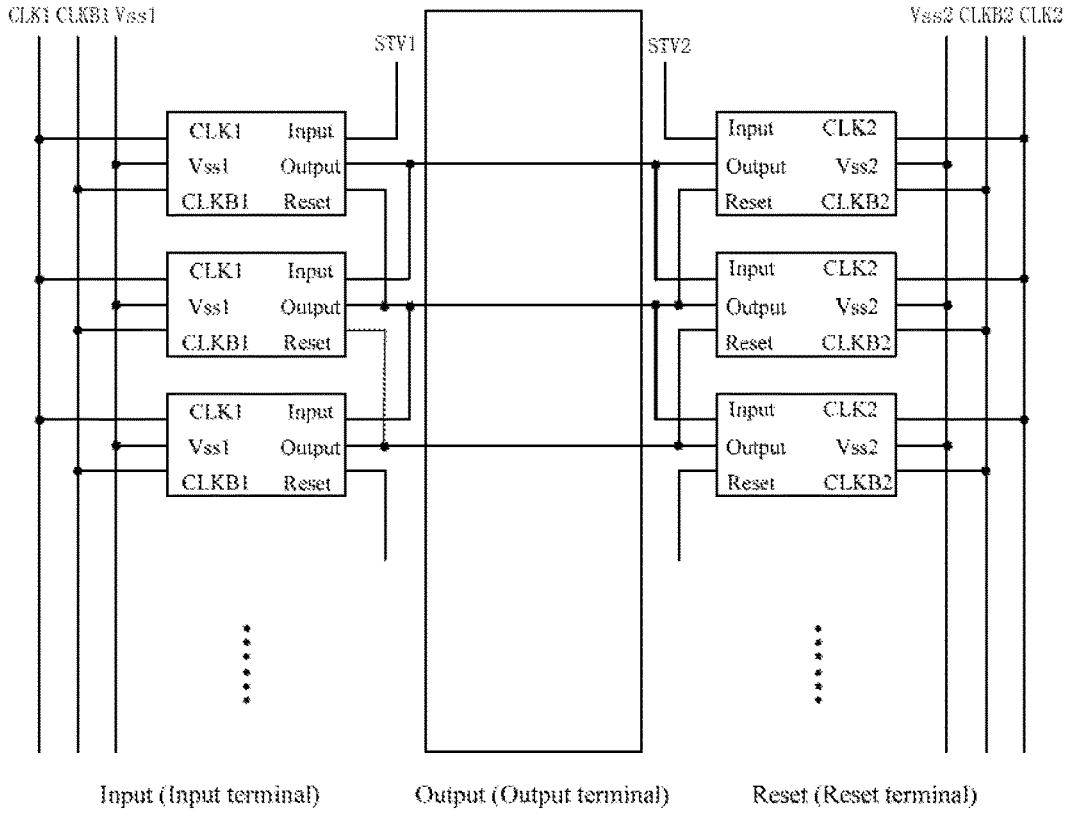
FIG. 5 is a schematic diagram of the structure of a dual-gate driving circuit of an embodiment of the present invention.

Specifically, as shown in FIG. 4 to FIG. 5, the first gate driving circuit receives the STV1 signal, and the second gate driving circuit receives the STV2 signal. The first gate driving circuit includes multiple first sub-gate driving circuits. The second gate driving circuit includes multiple second sub-gate driving circuits. Each of the first sub-gate driving circuit and each of the second sub-gate driving circuit each have an input terminal Input, an output terminal Output and a reset terminal Reset. The output of each row of sub-gate driving circuit is taken as the input of the next row of sub-gate driving circuit and taken as reset of the last row of sub-gate driving circuit. The input terminal of the first row of sub-gate driving circuit is connected with the frame start signal.

Figure 6:
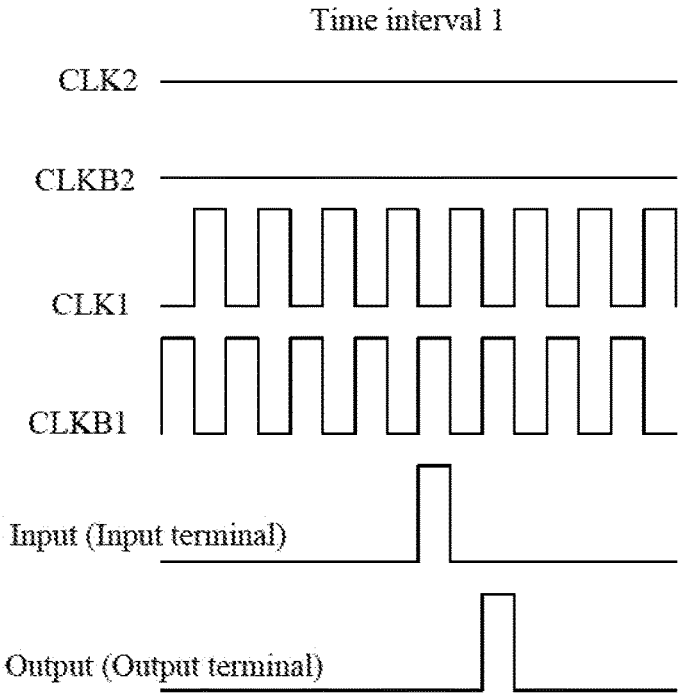
FIG. 6 is a schematic diagram of a waveform of the voltage of the dual-gate driving circuit of an embodiment of the present invention.
Figure 7:
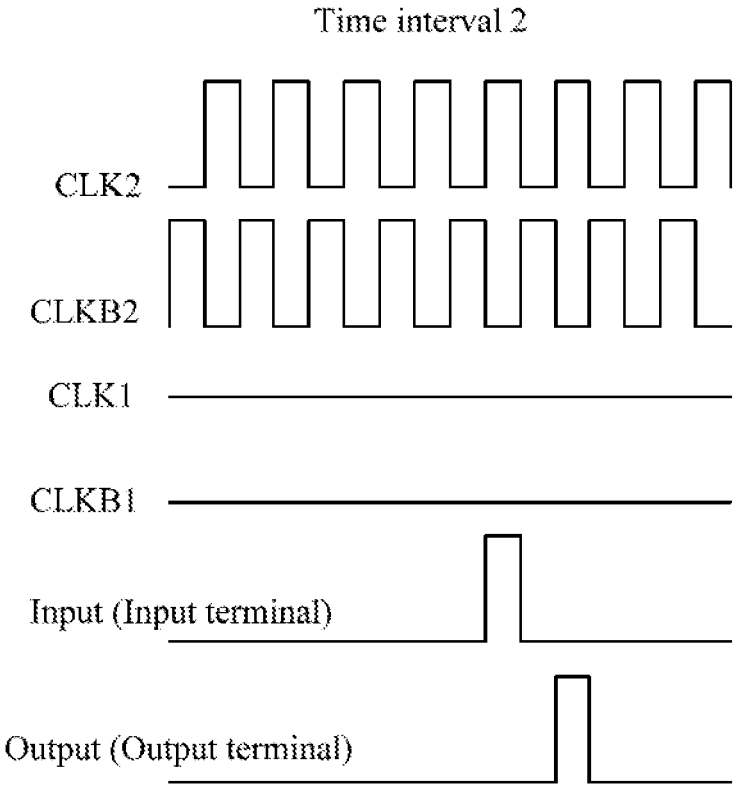
FIG. 7 is a schematic diagram of a waveform of the voltage of the dual-gate driving circuit of an embodiment of the present invention.

As shown in FIG. 5 to FIG. 7, each of the first sub-gate driving circuit also includes a first normal phase clock signal input terminal CLK1, a first inverse phase clock signal input terminal CLKB1 and a first low voltage signal input terminal Vss1. Each of the second sub-gate driving circuit includes a second normal phase clock signal input terminal CLK2, a second inverse phase clock signal input terminal CLKB2 and a second low voltage signal input terminal Vss2. The output terminal of each sub-gate driving circuit of the first gate driving circuit and the output terminal of each sub-gate driving circuit of the second gate driving circuit are separately correspondingly connected to a same gate line.

In a time period 1, the first gate driving circuit is in a working state, and receives the input signals of the first normal phase clock signal input terminal CLK1, the first inverse phase clock signal input terminal CLKB1 and the first low voltage signal input terminal Vss1. At the moment, the second gate driving circuit is in a dormant state, and does not receive the input signals of the second normal phase clock signal input terminal CLK2, the second inverse phase clock signal input terminal CLK2 and the second low voltage signal input terminal Vss2. In a time period 2, the first gate driving circuit is in a dormant state, and does not receive the input signals of the first normal phase clock signal input terminal CLK1, the first inverse phase clock signal input terminal CLKB1 and the first low voltage signal input terminal Vss1. At the moment, the second gate driving circuit is in a working state, and receives the input signals of the second normal phase clock signal input terminal CLK2, the second inverse phase clock signal input terminal CLKB2 and the second low voltage signal input terminal Vss2. At the same moment, only one set of the two sets of gate driving circuit is in a working state, and the other is in a dormant state. The switching time in working of the two sets of gate driving circuit may adopt many modes. Specifically, the second gate drive circuit is turned off so that the second gate drive circuit does not work, the first gate drive circuit is works, and then the first gate drive circuit is turned off so that the first gate drive circuit does not work. At the same time, the second gate drive circuit works after restart. Or a timed switching mode is adopted, that is, after the first gate driving circuit works for a period of set time, the second gate driving circuit also starts to work for a period of set time, so as to ensure that two sets of gate driving circuits are used for switching the display, obvious picture display difference is not caused, and occurrence of extra display problem is avoided while the aim of switching the display by two sets of gate driving circuits is ensured.

Moreover, the first gate driving circuit and the second gate driving circuit may be controlled to enter a working state or a dormant state by power on-off. In the present embodiment, optionally, when the first preset condition is met, the power source of the first gate driving circuit is turned off, and meanwhile, the power source of the second gate driving circuit is tuned on. The originally working first gate driving circuit enters the dormant state, and the originally dormant second gate driving circuit starts to work. When the second preset condition is met, the power source of the first gate driving circuit is turned on, and meanwhile, the power source of the second gate driving circuit is turned off. The originally dormant first gate driving circuit starts to work, and the originally working second gate driving circuit starts to enter the dormant state. The two works alternately, so as to prolong the service life of the display panel while ensuring the display property of the display panel.

Figure 8:
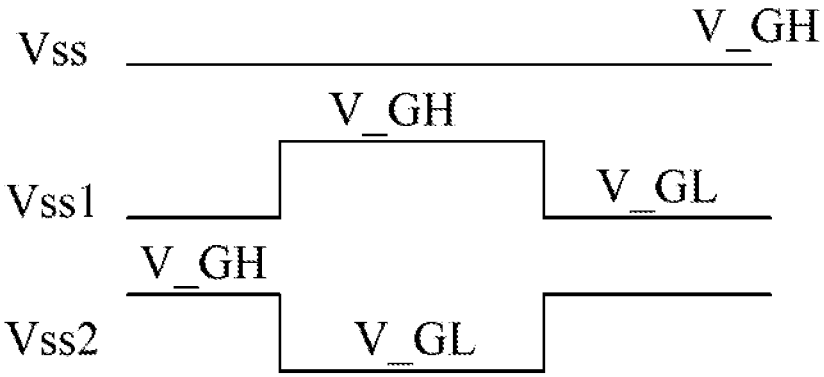
FIG. 8 is a schematic diagram of a voltage signal input waveform of an embodiment of the present invention.

Switching signals output to the first gate driving circuit and the second gate driving circuit may be different, and the first gate driving circuit and the second gate driving circuit are respectively controlled. As shown in FIG. 5 and FIG. 8, when the first preset condition is met, a high level signal is output to the first gate driving circuit and the second gate driving circuit at the same time, the power source of the first gate driving circuit is turned off, and meanwhile, the power source of the second gate driving circuit is turned on. When the second preset condition is met, a low level signal is output to the first gate driving circuit and the second gate driving circuit at the same time, the power source of the first gate driving circuit is turned on, and meanwhile, the power source of the second gate driving circuit is turned off. A high level signal and a low level signal are output to the first gate driving circuit and the second gate driving circuit at the same time, the power source of one of the gate driving circuits is turned off, and the power source of the other gate driving circuit is turned on. Although the two gate driving circuits receive the same level signals, they do not work at the same time, switching is performed once in each time of powering off. For example, before powering off, the first gate driving circuit works, and after powering off, the second gate driving circuit works after restart. Or a timed switching mode is adopted, that is, after the first gate driving circuit works for a period of set time, the second gate driving circuit also starts to work for a period of set time.

Certainly, the signal of the first low voltage signal input terminal Vss1 received by the first gate driving circuit and the signal of the second low voltage signal input terminal Vss2 received by the second gate driving circuit may be the same. However, reversing processing (for example, a reverser) needs to be performed on voltage signal input between the first gate driving circuit or the second first gate driving circuit and the switcher, so as to control one of the first gate driving circuit and the second first gate driving circuit to work, and the other one to enter the dormant state.

Figure 9:
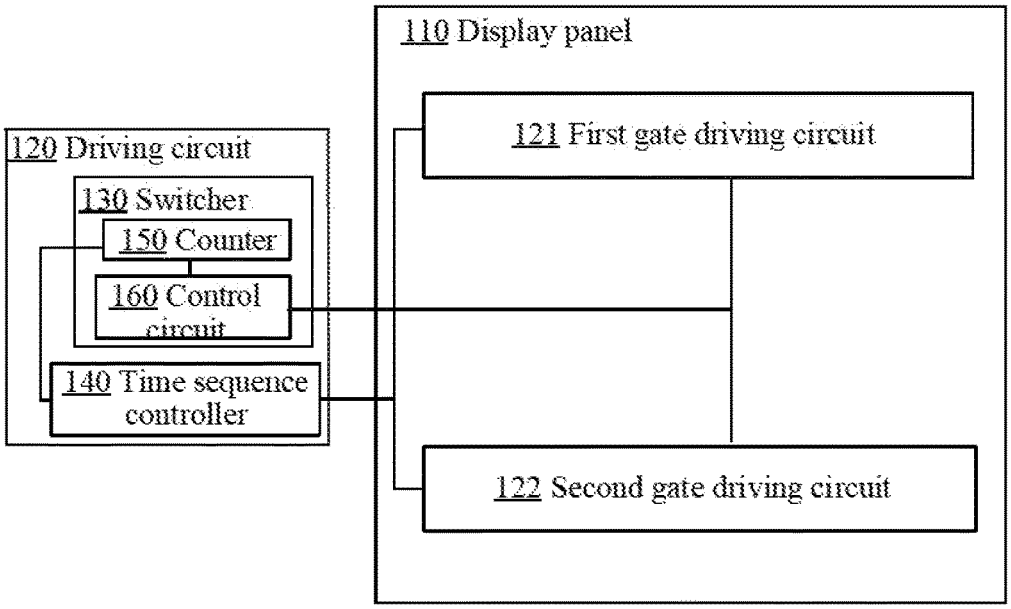
FIG. 9 is a schematic diagram of a driving module in a display panel and the display panel of an embodiment of the present invention.

As shown in FIG. 9, as another embodiment of the present invention, the present invention also discloses a driving circuit 120 of the display panel 110. The driving circuit 120 includes a time sequence controller 140 and a switcher 130. The time sequence controller 140 outputs first input signals to the first gate driving circuit 121 of the display panel, and outputs second input signals to the second gate driving circuit 122 of the display panel. The switcher 130 is in controlled connection with the first gate driving circuit 121 of the display panel and the second gate driving circuit 122 of the display panel, and controls only one of the first gate driving circuit and the second gate driving circuit to be in working at the same time according to the first preset condition or the second preset condition.

The switcher 130 includes a counter 150 and a control circuit 160. The counter 150 is used for counting a scanning frame number of the first gate driving circuit or the second gate driving circuit output by the time sequence controller 140. The control circuit is in controlled connection with the counter, and controls to connect the first gate driving circuit or the second gate driving circuit of the display panel. When the scanning frame number counted by the counter reaches a preset switching value, it is regarded as reaching the preset time interval, that is, when the first preset condition or the second preset condition is met, the counter informs the control circuit, and the control circuit outputs a corresponding frame start signal to the first gate driving circuit and the second gate driving circuit, so that switching is precisely performed, time is not wasted, and voltage consumption caused by existence of an idle section is avoided. Certainly, a timing module may also be included, in which timing may be taken as a criterion for judging whether the first preset condition or the second preset condition is met.

Figure 10:
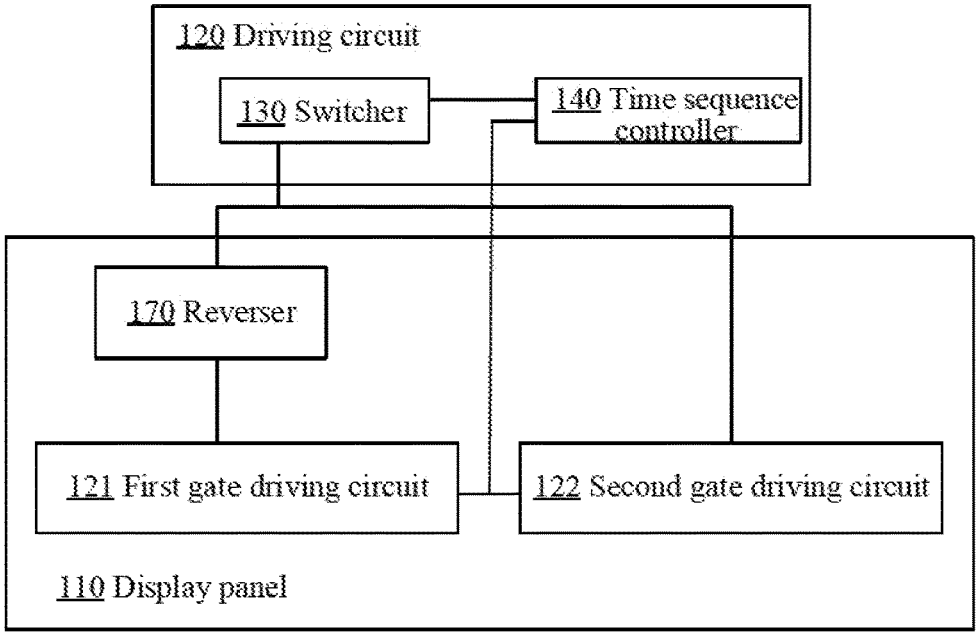
FIG. 10 is a schematic diagram of the display panel including a reverser of an embodiment of the present invention.

As shown in FIG. 10, the signal of the first low voltage signal input terminal Vss1 received by the first gate driving circuit and the signal of the second low voltage signal input terminal Vss2 received by the second gate driving circuit may be the same. However, reversing processing (for example, a reverser) needs to be performed on signals between the first gate driving circuit or the second first gate driving circuit and the switcher. Correspondingly, the display panel includes a reverser 170. The reverser 170 is used to convert the input high level signal to low level signal and output the low level signal, or convert the input low level signal to high level signal and output the high level signal. The reverser 170 is coupled between the first gate driving circuit and the switcher or coupled between the second gate driving circuit and the switcher. When the reverser is coupled between the first gate driving circuit and the switcher, if high level signal is input to the first low voltage signal input terminal Vss1 and the second low voltage signal input terminal Vss2 at the same time, a signal input to the first low voltage signal input terminal Vss1 after reversion is low level signal, while what is received by the second low voltage signal input terminal Vss2 is still the high level signal. If low level signal is input to the first low voltage signal input terminal Vss1 and the second low voltage signal input terminal Vss2 at the same time, a signal input to the first gate driving circuit after reversion is high level signal, while what is received by the second gate driving circuit is still the low level signal. Similarly, it is the same when the reverser is coupled between the second gate driving circuit and the switcher. The reverser may be arranged on the display panel, and is processed together with the first gate driving circuit and the second gate driving circuit.

Figure 11:
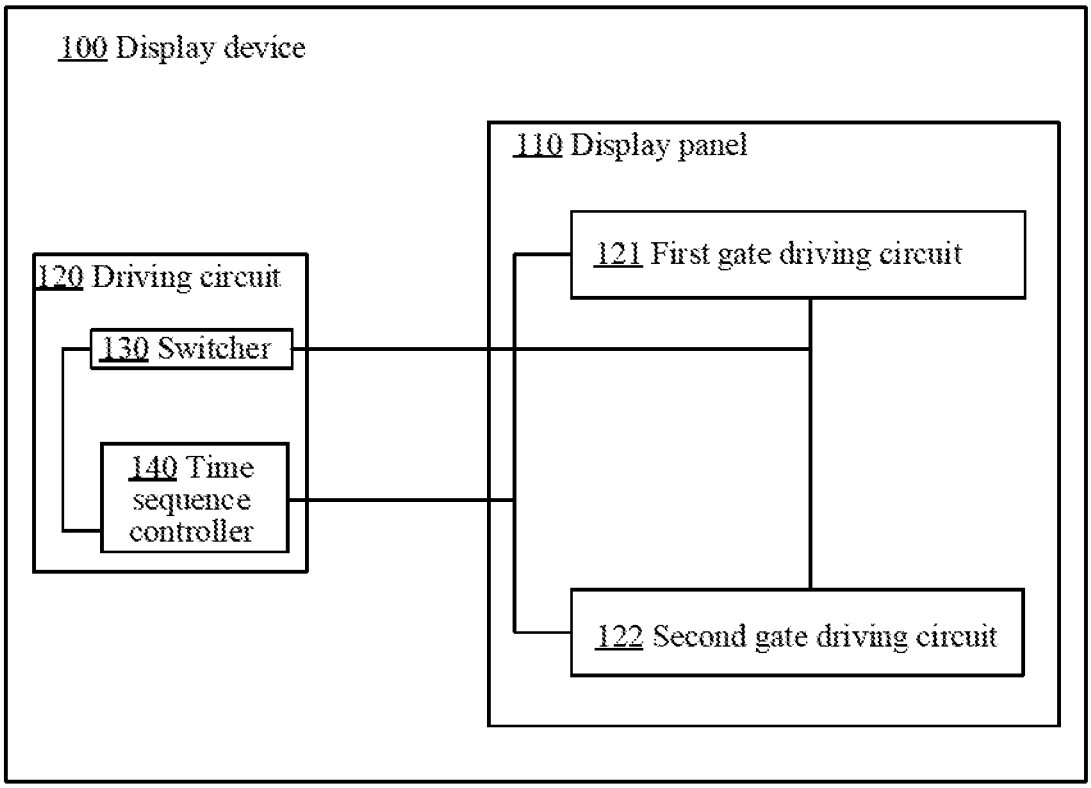
FIG. 11 is a schematic diagram of a display device of an embodiment of the present invention.

As another embodiment of the present invention, as shown in FIG. 11, the present invention also discloses a display device 100, including the display panel 110 and the foregoing driving circuit 120 of the display panel. The display panel is divided into a display area and a non-display area. The display panel includes the first gate driving circuit 121 and the second gate driving circuit 122. The first gate driving circuit 121 is arranged in the non-display area, and controls to output a gate start signal to be used for scanning all gate lines in the display area. The second gate driving circuit 122 is arranged in the non-display area, and controls to output a gate start signal to be used for scanning all gate lines in the display area. The driving circuit 120 includes a switcher 130 and a time sequence controller 140. The time sequence controller 140 outputs first input signals to the first gate driving circuit 121 and outputs second input signals to the second gate driving circuit 122. The switcher 130 is in controlled connection with the first gate driving circuit and the second gate driving circuit, and controls only one of the first gate driving circuit and the second gate driving circuit to be in working at the same time according to the first preset condition or the second preset condition.

What needs to be noted is that limitation of each step related in the scheme should not be recognized as limitation to the sequential order of the steps on the premise of not affecting the implementation of a specific scheme, the steps written in front may be executed first, and also may be executed afterwards, and even may be executed at the same time, and it should be deemed as belonging to the protective scope of the present invention as long as the scheme may be implemented.

The technical scheme of the present invention may be widely applied to a TN panel (with full name of Twisted Nematic Panel), an IPS panel (with full name of In-Plane Switching Panel), a VA panel (with full name of Multi-domain Vertical Alignment Panel), and certainly, may be other suitable types of panels.

The foregoing contents are detailed descriptions of this application in conjunction with specific optional embodiments, and it should not be considered that the specific implementation of this application is limited to these descriptions. A person of ordinary skill in the art may also make some simple deduction or substitution on the premise of not departing from the concept of the present invention, and it should be all deemed as belonging to the protective scope of the present invention.

What is claimed is:

1. A driving method of a display panel, wherein the display panel comprises:

a first gate driving circuit, which receives first input signals, and controls to output a gate start signal to be used for scanning all gate lines in a display area of the display panel; and a second gate driving circuit, which receives second input signals associated with the first input signals, and controls to output a gate start signal to be used for scanning all gate lines in the display area of the display panel; and the method comprises:

when a first preset condition is met, controlling the first gate driving circuit to be in a dormant state, and meanwhile, controlling the second gate driving circuit to be in a working state; and when a second preset condition is met, controlling the second gate driving circuit to be in a dormant state, and meanwhile, controlling the first gate driving circuit to be in a working state;

when the first preset condition is met, outputting a high level signal to the first gate driving circuit and the second gate driving circuit at the same time, turning off the power source of the first gate driving circuit, and meanwhile, turning on the power source of the second gate driving circuit; and when the second preset condition is met, outputting a low level signal to the first gate driving circuit and the second gate driving circuit at the same time, turning on the power source of the first gate driving circuit, and meanwhile, turning off the power source of the second gate driving circuit.

2. The driving method of a display panel according to claim 1, wherein the first preset condition refers to that timing is carried out from the moment of start of the first gate driving circuit, and when the timing time reaches a first preset time interval, the first preset condition is met; and the second preset condition refers to that timing is carried out from the moment of start of the second gate driving circuit, and when the timing time reaches a second preset time interval, the second preset condition is met.

3. The driving method of a display panel according to claim 1, wherein the first preset condition refers to that a scanning frame number from the start of the first gate driving circuit is counted, and when the scanning frame number reaches a preset switching value, the first preset condition is met; and the second preset condition refers to that a scanning frame number from the start of the second gate driving circuit is counted, and when the scanning frame number reaches a preset switching value, the second preset condition is met.

4. A driving circuit of a display panel, the driving circuit comprising:

a time sequence controller, which outputs first input signals to a first gate driving circuit of the display panel, and outputs second input signals to a second gate driving circuit of the display panel; and a switcher, which is in controlled connection with the first gate driving circuit of the display panel and the second gate driving circuit of the display panel, and controls only one of the first gate driving circuit and the second gate driving circuit to be in working at the same time according to the first preset condition or the second preset condition;

wherein the driving circuit of a display panel comprises a reverser, the reverser converts an originally input high level into low level signal output or converts an originally input low level into high level signal output, and the reverser is arranged between the first gate driving circuit and the switcher, and is coupled to the first gate driving circuit and the switcher.

5. The driving circuit of a display panel according to claim 4, wherein the switcher comprises:

a counter, which is used for counting a scanning frame number of the first gate driving circuit or the second gate driving circuit output by the time sequence controller; and a control circuit, which is in controlled connection with the counter, and controls to connect the first gate driving circuit or the second gate driving circuit of the display panel, wherein, when the scanning frame number counted by the counter reaches a preset switching value, it is regarded as reaching a preset time interval, that is, when the first preset condition or the second preset condition is met, the counter informs the control circuit, and the control circuit outputs a corresponding frame start signal to the first gate driving circuit and the second gate driving circuit.

6. The driving circuit of the display panel according to claim 4, wherein the time sequence controller presets a time interval to be taken as a first time interval or a second time interval for switching between the first gate driving circuit and the second gate driving circuit.

7. The driving circuit of a display panel according to claim 5, wherein a numerical value is preset on the counter to be taken as a switching value in switching between the first gate driving circuit and the second gate driving circuit.

8. A display device, comprising a display panel and a driving circuit, wherein the display panel is divided into a display area and a non-display area, the display panel comprises:

a first gate driving circuit, which is arranged in the non-display area, and controls to output a gate start signal to be used for scanning all gate lines in the display area; and a second gate driving circuit, which is arranged in the non-display area, and controls to output a gate start signal to be used for scanning all gate lines in the display area; and the driving circuit comprises:

a time sequence controller, which outputs first input signals to the first gate driving circuit and outputs second input signals to the second gate driving circuit; and a switcher, which is in controlled connection with the first gate driving circuit and the second gate driving circuit, and controls only one of the first gate driving circuit and the second gate driving circuit to be in working at the same time according to the first preset condition or the second preset condition;

wherein each of the first sub-gate driving circuits and each of the second sub-gate driving circuits each comprise an output terminal, an input terminal and a reset terminal, and the output terminal of each of the first sub-gate driving circuits is connected with the output terminal of each of the correspondingly arranged second sub-gate driving circuits;

wherein the first sub-gate driving circuit comprises a first normal phase clock signal input terminal, a first inverse phase clock signal input terminal and a first low voltage signal input terminal; and the second sub-gate driving circuit comprises a second normal phase clock signal input terminal, a second inverse phase clock signal input terminal and a second low voltage signal input terminal.

9. The display device according to claim 8, wherein the switcher comprises:

a counter, which is used for counting a scanning frame number of the first gate driving circuit or the second gate driving circuit output by the time sequence controller; and a control circuit, which is in controlled connection with the counter, and controls to connect the first gate driving circuit or the second gate driving circuit of the display panel, wherein, when the scanning frame number counted by the counter reaches a preset switching value, it is regarded as reaching a preset time interval, that is, when the first preset condition or the second preset condition is met, the counter controls the control circuit to output a corresponding frame start signal to the first gate driving circuit and the second gate driving circuit.

10. The display device according to claim 8, wherein the switcher comprises:

a timer, which is used for timing the starting time of the first gate driving circuit or the second gate driving circuit; and a control circuit, which is in controlled connection with the timer, and controls to connect the first gate driving circuit or the second gate driving circuit of the display panel, wherein, when the time timed by the timer reaches a preset time, it is regarded as reaching a preset time interval, that is, when the first preset condition or the second preset condition is met, the timer informs the control circuit, and the control circuit outputs a corresponding frame start signal to the first gate driving circuit and the second gate driving circuit.

11. The display device according to claim 8, wherein the first gate driving circuit comprises multiple first sub-gate driving circuits, and the second gate driving circuit comprises multiple second sub-gate driving circuits, wherein the first sub-gate driving circuits and the second sub-gate driving circuits are respectively correspondingly connected to a same gate line.

* * * * *